US007124478B2

(12) United States Patent
Aquillon et al.

(10) Patent No.: US 7,124,478 B2
(45) Date of Patent: Oct. 24, 2006

(54) BRACELET CLASP

(75) Inventors: Alain Aquillon, Geneva (CH); Jean-Marc Deriaz, Collonge Bellerive (CH); Daniel Moille, Yvoire (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 11/248,904

(22) Filed: Oct. 11, 2005

(65) Prior Publication Data

US 2006/0090305 A1 May 4, 2006

(30) Foreign Application Priority Data

Nov. 3, 2004 (EP) ..... 04405673

(51) Int. Cl.
*A44C 5/14* (2006.01)

(52) U.S. Cl. ..... 24/265 WS; 24/71 J; 24/265 BC; 24/265 EC

(58) Field of Classification Search ..... 24/265 WC, 24/71 J

See application file for complete search history.

(56) References Cited

U.S. PATENT DOCUMENTS 5,689,861 A 11/1997 Petignat
5,771,543 A * 6/1998 Froidevaux et al. ..... 24/71 J
5,781,968 A * 7/1998 Widmer ..... 24/71 J
6,185,799 B1 * 2/2001 Gay ..... 24/715
6,324,735 B1 * 12/2001 Chen ..... 24/71 SK
6,588,069 B1 * 7/2003 Deriaz et al. ..... 24/265 WS

FOREIGN PATENT DOCUMENTS

CH 689931 2/2000
GB 632119 11/1949

* cited by examiner

*Primary Examiner*—Robert J. Sandy
*Assistant Examiner*—Marcus Menezes
(74) *Attorney, Agent, or Firm*—Sturm & Fix LLP

(57) ABSTRACT

This clasp comprises at least two branches (1, 2) articulated on one another via one of their respective ends. One of the free ends of these branches (1, 2) comprises a lever (12, 22, 33) articulated about a shaft (10, 20, 32) parallel to the articulation shaft (3) of said branches (1, 2) and fixedly attached to a hook (17, 27, 33*c*), the other of the free ends of these branches comprising a coupling element (4, 34) shaped to allow the hook (17, 27, 33*c*) to engage therewith, to keep the branches (1, 2) in the folded position. The lever (12, 22, 33) comprises elastic means (15, 25, 37) to exert a torque thereon and abutment means (13, 23) to limit its pivoting, under the effect of the torque, about said shaft (10, 20, 32) in a position corresponding at least to the engagement of said latching hook (17, 27, 33*c*) with the coupling element (4, 34), in which the elastic means (15, 25, 37) are under tension, such that the lever (12, 22, 33) must pivot against the elastic means (15, 25, 37) to engage and to disengage the latching hook (17, 27, 33*c*) of the coupling element (4, 34).

20 Claims, 3 Drawing Sheets

BRACELET CLASP

CROSS REFERENCE TO RELATED APPLICATIONS

This application claims priority of European Application No. 04405673.7 filed Nov. 3, 2004, which is included in its entirety by reference made hereto.

BACKGROUND OF THE INVENTION

The present invention relates to a bracelet clasp comprising at least two branches articulated on one another via one of their respective ends, a latching device for keeping the free ends of these two branches in the folded position and linkage means between their free ends and the respective ends of a bracelet.

This type of clasp is well known particularly in the field of clasps for watch bracelets. The folding branches of the clasp are used to very substantially increase the length of the bracelet in the open position of the clasp, which allows the bracelet watch to be passed around the hand without needing to separate the bracelet.

DESCRIPTION OF THE PRIOR ART

There is a large number of coupling or latching systems for this type of clasp. Most of them use the elasticity of the folding branches of the clasp. The elastic properties of such clasps are therefore a result of the material and the dimensions of the clasp branches. One and the same clasp will therefore not have the same features if it is made of steel or of gold for example, if the branches are machined in a single piece or if they are made of pressed metal sheet.

A proposal has already been made in EP 1 279 349 of a clasp with folding branches comprising one or two levers articulated about shafts perpendicular to one of the branches of the bracelet and returned to the latched position by a spring placed transversely to the blades of the clasp, such that these levers can be accessed on the two opposite lateral faces of the clasp on which they protrude. These levers each have an inner rim which extends in a plane perpendicular to the respective pivoting shafts of the levers and that is intended to engage on complementary rims of a latching member fixedly attached to one end of another branch of the clasp. By spreading the rims of the levers by pressures exerted on them against the force exerted by the spring, the latching member may penetrate between the levers and is trapped when the pressure is released from the levers that are returned to their latched position by the pressure of the spring.

Although this solution can be used to make the latching independent of the elastic properties of the blades or branches of the clasp, it has a number of defects. One of them concerns safety. The actuation of the levers to control the opening of the clasp is the result of a simple pressure on pushbuttons which protrude laterally from the clasp. Because of this the clasp may be opened accidentally or unintentionally following an unconscious pressure on the pushbuttons. This risk is evidently unacceptable, particularly for a costly watch.

A proposal has been made to remedy this disadvantage in EP 1 374 716, in which the device for coupling the two bracelet branches is associated with a latching system which comprises a member for locking the pushbutton preventing it from being actuated unintentionally.

Another disadvantage of the two abovementioned devices arises from the fact that the force that the return spring exerts on the levers is not exerted on the branches of the clasp, so that a clearance may subsist between the latter when they are in the closed position, which is seen to be a defect by the wearer of the bracelet watch and is therefore not acceptable for a product of quality.

SUMMARY OF THE INVENTION

The object of the present invention is to remedy at least in part the abovementioned disadvantages.

Consequently, the subject of this invention is a bracelet clasp according to the definition given by claim 1.

Unlike the abovementioned solution in which there are simple pushbuttons on which the force of the return spring acts directly, it will be noticed that the lever of the clasp according to the invention clearly acts on the elastic return means such as a lever, which allows it to obtain a gearing down of the force exerted thereon to cause the elastic return means to flex. Thanks to this gearing down of the manual force exerted on the lever to open the clasp, the force of the elastic return means can be increased and therefore the force that is exerted on the latching hook can be increased. This force continues to be exerted in the closed position, holding the branches tight against one another, thus taking up the clearances between the branches of the clasp.

BRIEF DESCRIPTION OF THE DRAWINGS

There are several other advantages that will be discovered on reading the following description made with the aid of the appended drawings which illustrate, schematically and as an example, three embodiments of the clasp that is the subject of the present invention.

DESCRIPTION OF THE PREFERRED EMBODIMENTS

Figure 1:
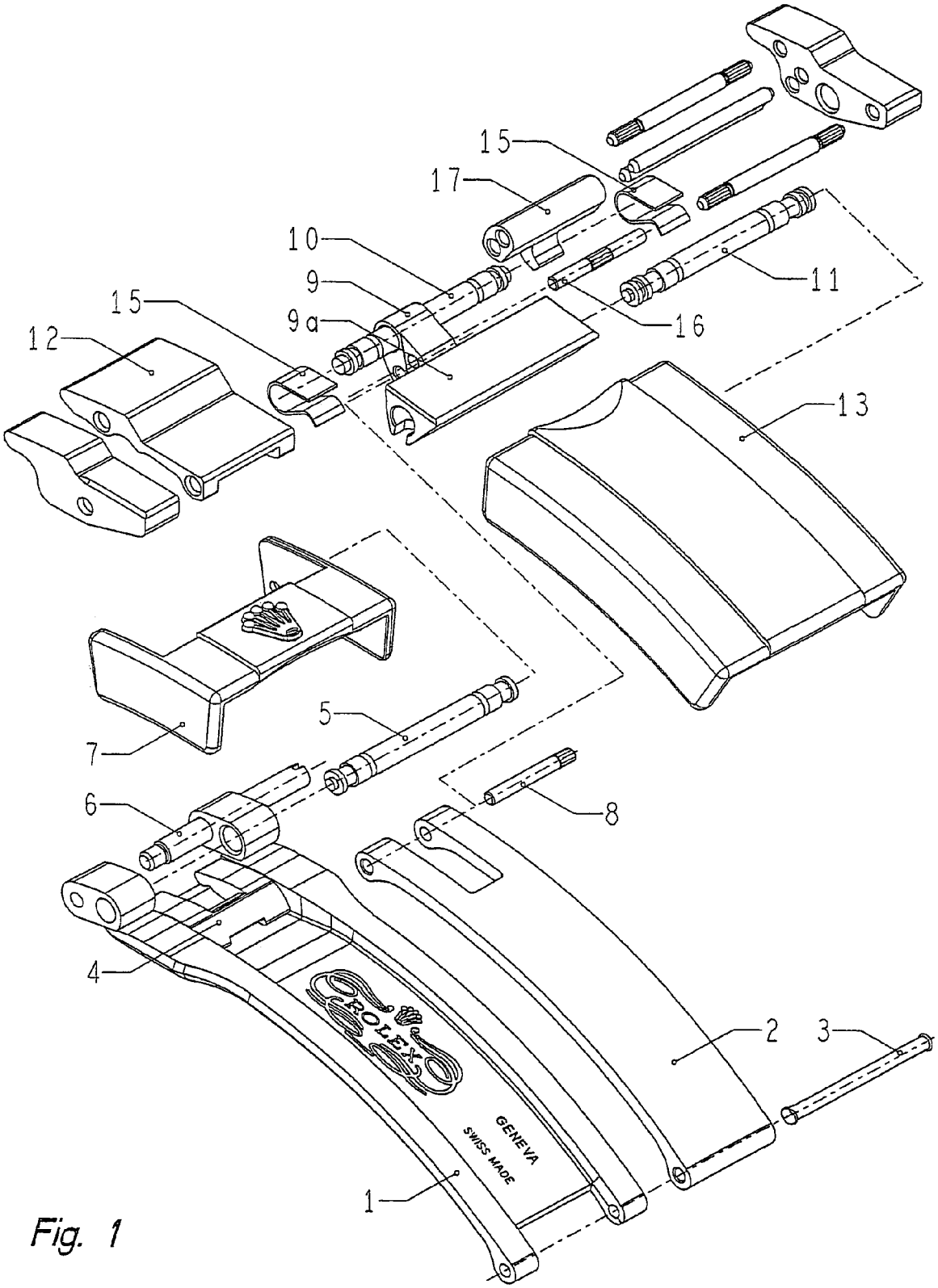
FIG. 1 is an exploded view of a first embodiment.
Figure 2:
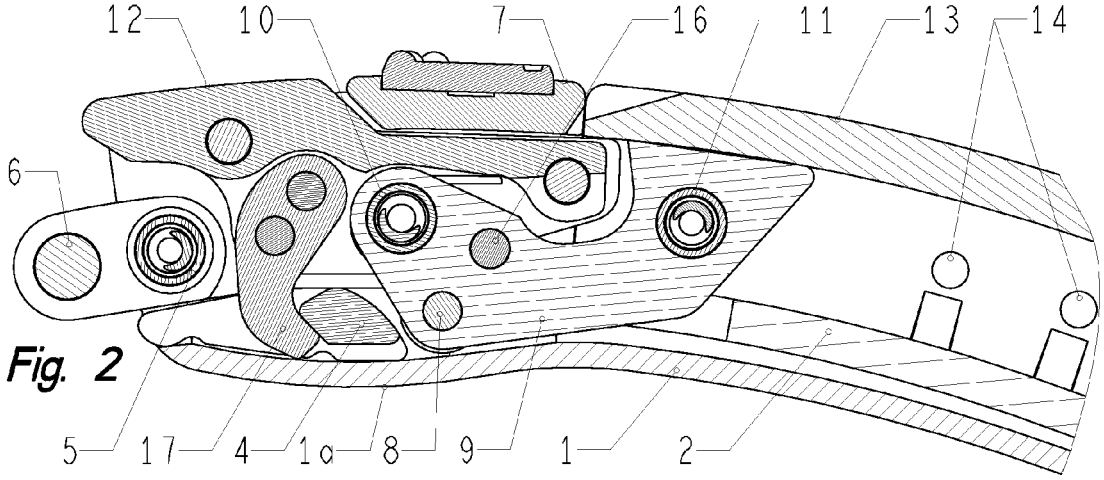
FIG. 2 is a first view in longitudinal section on a first sectional plane, in the closed position of a first embodiment.
Figure 3:
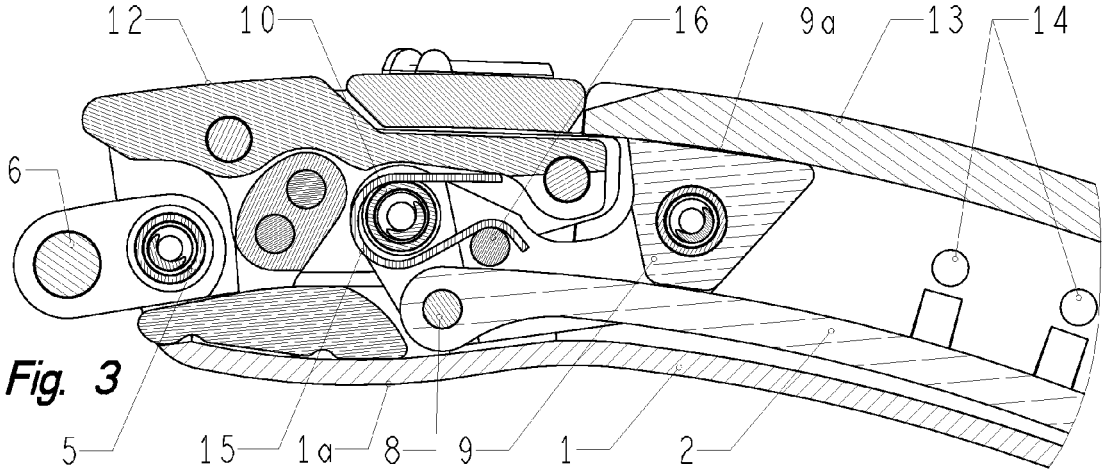
FIG. 3 is a second view in longitudinal section on a second sectional plane, in the closed position of this same embodiment.
Figure 4:
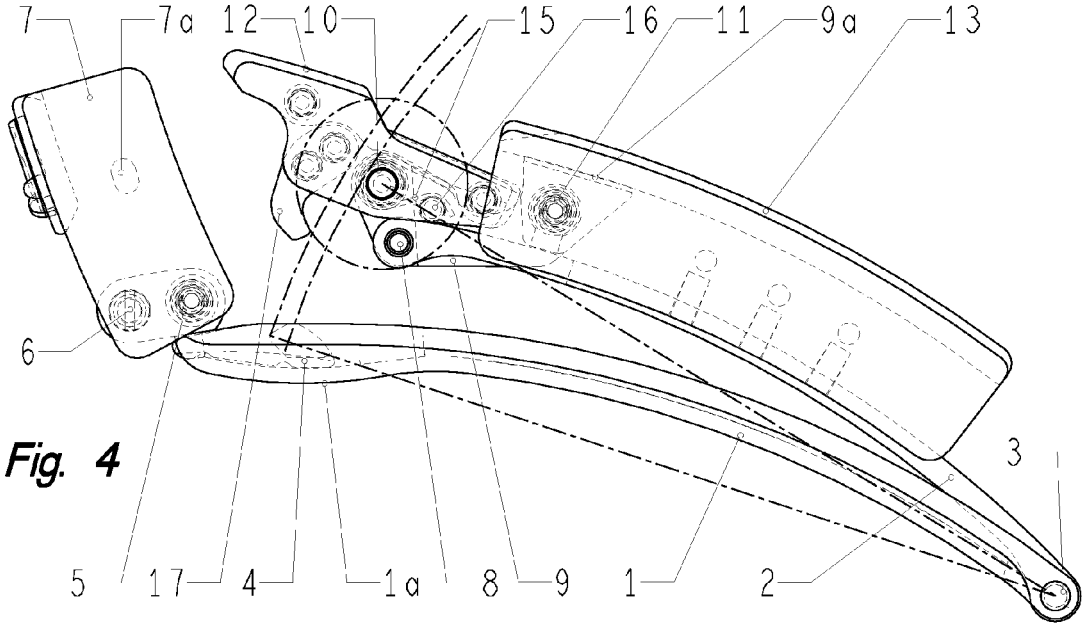
FIG. 4 is a view in longitudinal section of the clasp according to this embodiment, in the open position.

The clasp illustrated in FIGS. 1 to 4 comprises two branches 1, 2 articulated by one of their ends about a shaft 3 (FIG. 4). The free end of the branch 1 has a coupling element 4 which, in this embodiment, has the shape of a transverse element, parallel to the articulation shaft 3. This coupling element 4 is situated in a portion 1*a* of the free end of the branch 1, curved outward. A space is made between this coupling element 4 and the bottom of this curved portion 1*a* to make it possible to insert a coupling member between the coupling element 4 and the bottom of the curved portion 1*a* as will be explained hereinafter. This same free end is again fixedly attached to the two articulation shafts 5, 6, parallel to the articulation shaft 3 of the branches 1, 2. One 5 of these shafts is used for the articulation of a latching cover 7, while the other is used for the articulation of an end of one of the lengths of the bracelet (not shown).

The free end of the branch 2 is thicker than the rest of this branch, in order to receive an articulation shaft 8. This extra thickness is obtained by curving the face of this branch 2 turned toward the branch 1, such that, in the closed portion, this curved face of the branch 2 substantially matches the shape of the beginning of the curved position 1*a* due to the fact that it is shorter than the branch 1, as can be seen in FIG. 3.

A linkage member 9 is articulated at the free end of the branch 2 about the articulation shaft 8 so that it can articulate freely through at least 180° in order to facilitate the deployment of this branch 2 for the hand to pass freely through it in the open position. This linkage member 9 comprises two other shafts 10 and 11. The shaft 10 is used for the articulation of a latching lever 12 and the shaft 11 is used to connect a cover 13. The latter has two parallel lateral walls in which is made a plurality of pairs of positioning elements formed by circular recesses 14 on their opposite internal faces, for the attachment of a bar (not shown) in one or other pair of recesses, depending on the length desired for the bracelet.

The linkage member 9 has a surface 9*a* adjacent to the internal face of the top wall of the cover 13. This surface 9*a* serves to prevent the cover 13 from pivoting about the shaft 11. The end of this cover 13, situated on the side of the free end of the branch 2, covers the rear end of the latching lever 12.

As can be seen in particular in FIG. 3, one end of a spring 15 presses on a rod 16 fixedly attached to the linkage member 9, passes around the articulation shaft 10 between this linkage member 9 and the latching lever 12 and the other end of this spring 15 presses against the internal face of the top wall of the latching lever 12. Consequently, this spring creates a torque on the latching lever 12 which tends to make it rotate anticlockwise in FIGS. 1–4. In reality, preferably, two springs 15 are placed along the pivot shaft 10, either side of the linkage member 9 which, for its part, is in the center of the pivot shaft 10.

The latching lever 12 supports a latching hook 17 shaped to be able to engage between the latching element 4 fixedly attached to the free end of the branch 1 and the bottom of the curved portion 1*a* of this branch 1, a position in which it is held by the torque applied thereto by the springs 15. In this latched position, the rear end of the latching lever 12, situated beneath the front end of the cover 13, transmits a torque to the latter via the linkage member 9. This torque is used to hold the cover 13 very close, or even to press it against the length of bracelet whose end is attached in one of the pairs of positioning elements formed of recesses 14 and prevents it from moving away therefrom. This means that the cover 13 does not risk getting caught during the movements made by the person wearing a bracelet furnished with the clasp according to the invention. In addition, a clasp whose cover may move freely away from the bracelet because of its clearance, spoils the look of this clasp and constitutes a depreciation factor thereof.

Dot and dash lines on FIG. 4 have been used to show the respective trajectories of the branch 2 about its articulation shaft 3 and of the latching hook 17 about its pivot shaft 10. It can be seen that the two trajectories intersect at an angle greater than 60°. Thanks to this disposition, in the latched position, any force exerted on the branches 1, 2 in a bid to separate them generates a force tangential to the circle of the trajectory of these branches passing through the point of contact between the latching hook 17 and the latching element 4, while the reaction of the hook 17 will be a perpendicular to the tangent at its trajectory about the pivot shaft 10 passing through this same point of contact. This perpendicular passes through the pivot shaft 10 and therefore creates no torque that would be likely to favor the opening of the clasp and does so, irrespective of the magnitude of the force applied to separate the branches 1 and 2. It is therefore a true latching device.

Only the lifting of the front portion of the lever 2 to make it pivot in the clockwise direction, against the torque of the springs 15, may cause the clasp to open. Theoretically, it would also be possible to exert a pressure on the portion of the lever 12 situated to the right of its articulation shaft 10 when looking at FIGS. 1–4. However, because the rear end of this portion of the lever 12 is situated beneath the cover 13, there is insufficient space available to exert this pressure manually. In addition, it would be necessary to act directly against the force of the springs 15, whereas by lifting the lever 12 by its front end, the user benefits from the lever arm that reduces the effort necessary to overcome the force of the springs.

It is therefore practically impossible to open the clasp unintentionally by exerting a pressure only on the right portion (with reference to FIGS. 1–4) of the lever 12, because the user has only difficult access to the portion closest to the shaft and the closer the user is to the shaft the greater is the force necessary to pivot it, all the more so because the user is then acting directly on the place where the force of the springs 15 is exerted on the lever 12. Conversely, the lifting of the lever 12 makes it possible to benefit from the lever arm, so that the pressure of the springs 15 may be chosen to be relatively high since the effort necessary to tilt the lever 12 for opening is reduced thanks to the lever arm. The accidental or inadvertent opening of this clasp is therefore practically out of the question.

The latching cover 7 is provided for additional security. It is intended to cover the latching lever 12 by flipping down, once the latching hook 17 has been coupled to the latching element 4. This latching cover 7 may be held in the pressed down position thanks to two recesses 7*a* made on the internal faces of its lateral walls which may come and snap onto the opposite ends of the pivot shaft 10 of the lever 12 which then protrude from the lateral faces of this lever 12 and can retract against the pressure of a helical spring placed in the pivot shaft 10, after the fashion of a piston bar well known for attaching a bracelet to the horns of a bracelet watch case.

The second embodiment (FIG. 5) differs essentially from the first embodiment by the absence of the second latching cover 7. Another difference lies in the fact that a shaft 20 serves as the articulation of the lever 22 on the linkage member 19, and serves to connect the cover 23 to this linkage member 19. The lever 22 is covered with a cap 28 which increases the length of the lever arm. This lever 22 supports a hook 27 intended to couple to the latching element 4 of the branch 1 exactly as in the first embodiment.

In this case, the return spring or springs 25 press on a pin 26 fixedly attached to the lever 22 at one of their ends and against the internal face of the upper wall of the linkage member 19 at their other ends, thus applying to the lever 22 a torque about the articulation shaft 20 directed in the anticlockwise direction.

Figure 5:
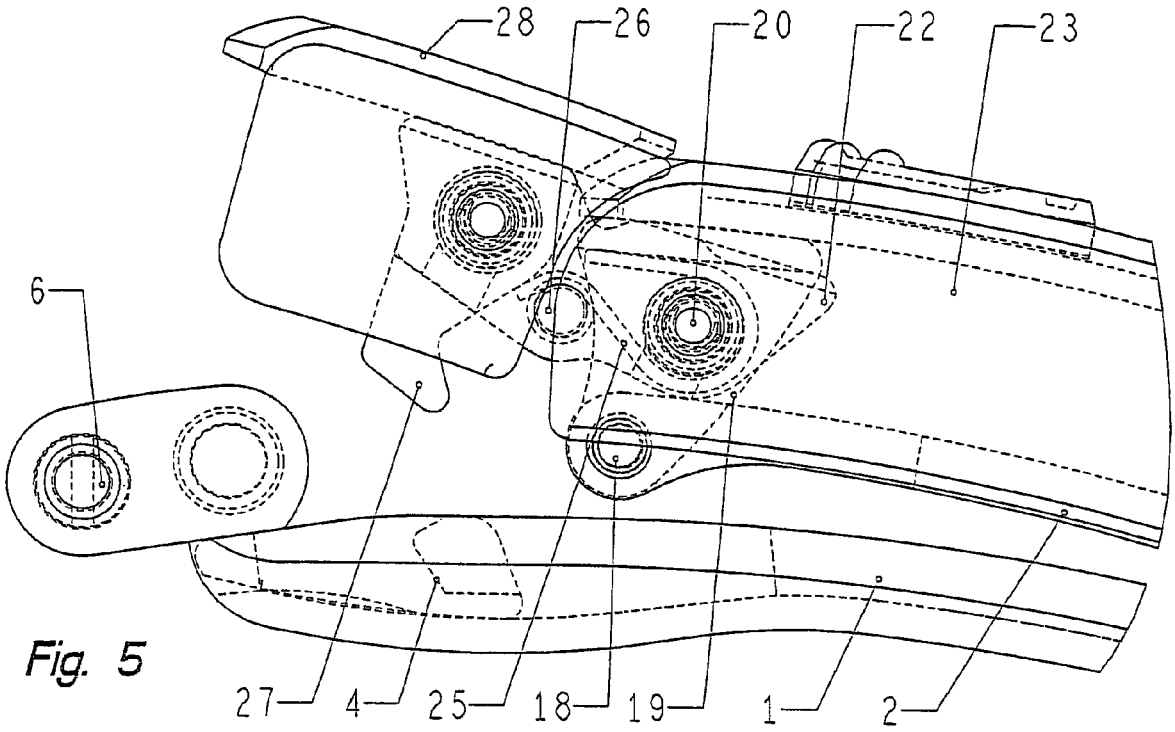
FIG. 5 is a view in section of a second embodiment, in the open position of the clasp.
Figure 6:
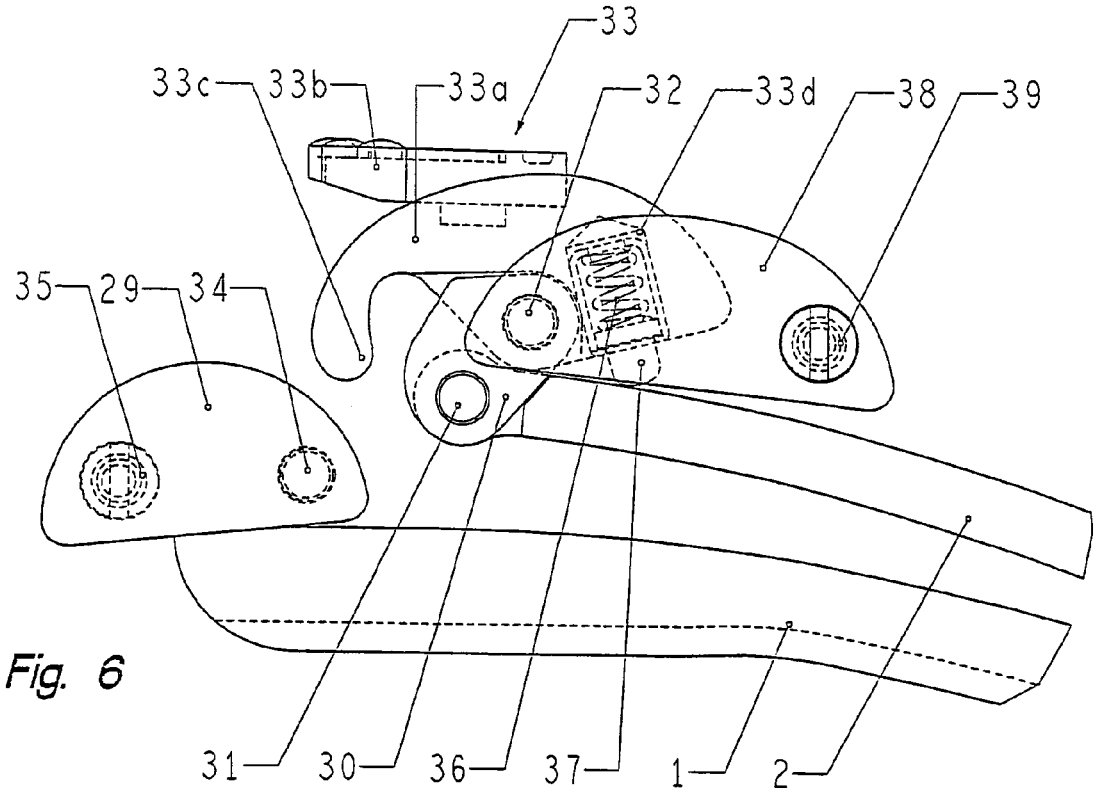
FIG. 6 is a view in longitudinal section of a third embodiment.

The third embodiment illustrated by FIG. 5 is intended to incorporate the clasp into an articulation chain link bracelet formed of at least three longitudinal rows of chain links, in which the links of one row are offset longitudinally by a half pitch from those of the adjacent row, the pitch corresponding to the longitudinal distance between two adjacent links of the same row.

The free end of the branch 1 is fixedly attached to at least one link 29, several similar links being able to be aligned transversely with the link 29 according to the number of rows of links that the bracelet to be connected to the clasp comprises. This or these links 29 comprise a transverse latching rod 34 and a screw shaft 35 to make the connection with the bracelet (not shown).

Similarly, the linkage member 30 that is articulated about an articulation shaft 31, at the free end of the branch 2, comprises a second articulation shaft 32 on which is articulated the latching lever 33 which has the external shape of a link 33*a* to which a grasping element 33*b* is attached. The lower face front portion of the latching lever 33 is recessed to form a hook 33*c*. A housing 33*d* is made in the rear portion of the lower face of the link-shaped lever 33*a* to house a cylinder 36 which encloses a helical spring and a piston 37 pressed outward by the helical spring. The stroke of this piston 37 is limited at its rear, larger diameter portion, so that the latter, at the end of the stroke, butts against the front face of the cylinder 36 through an opening in which the external visible portion, of smaller diameter, of the piston 37 passes. The outer end of this piston 37 presses against the upper face of the branch 2 of the clasp and applies to the lever 33 a torque about the articulation shaft 32 in the anticlockwise direction.

The articulation shaft 32 of the linkage member again serves for the articulation of two linkage links 38, situated transversely either side of the latching lever 33 in the shape of a link 33*a*. These linkage links 38 comprise a screw articulation shaft 39 for the attachment of one end of a length of the bracelet (not shown). The latching hook 33*c* is coupled to the latching rod 34 by lifting the lever 33 or causing it to pivot in the clockwise direction about the articulation shaft 32 against the force of the return spring exerted by means of the piston 37.

The invention claimed is:

1. A bracelet clasp comprising;

first branch having one free end and one articulation end;

a second branch having one free end and one articulation end said second branch being articulated with respect to the first branch at the first and second branch articulation ends;

a shaft of articulation upon which the first and second branches articulate at the articulation ends of the first and second branches;

a latching device for keeping the free ends of the first and second branches in a folded position relative to one another; and a link between the free ends of the first and second branches and respective ends of a bracelet, wherein the free end of the first branch comprises a lever, articulated about a lever shaft parallel to the shaft of articulation of said first and second branches and operatively, rigidly affixed to a latching hook, the free end of the second branch comprising a coupling element formed to engage said latching hook to keep said branches in the folded position, said lever comprising an elastic member to exert a torque thereon and a first stop to limit a range of pivot of the lever under the effect of said torque, to a position corresponding at least to an engagement of said latching hook with said coupling element wherein said elastic member is under tension, such that said lever must pivot against said elastic member during the engagement and a disengagement of said latching hook with said coupling element.

2. The clasp as claimed in claim 1 wherein, in a coupled position, said latching hook extends in a direction of the first branch, over a portion of said lever situated on a side of the lever shaft, opposite the articulation shaft and is curved in the direction of the articulation shaft, while a torque exerted on said lever by said elastic member tends to cause said latching hook to turn in a direction of the articulation shaft between said first and second branches such that the disengagement and engagement of said latching hook of said coupling element results respectively from a movement away from and toward a portion of said lever supporting said latching hook relative to said branch supporting the coupling element.

3. The clasp as claimed in claim 1, wherein said lever is operatively connected to the free end of said first branch by a second link comprising at least two additional articulation shafts parallel to the articulation shaft of said first and second branches, a first additional shaft for articulating the second link to the free end of said first branch, and a second additional shaft for articulating the second link to said lever.

4. The clasp as claimed in claim 3, wherein the second additional articulation shaft of said second link also serves as an articulation shaft of one end of the bracelet.

5. The clasp as claimed in claim 3, wherein said second link comprises a link shaft for a first cover having two parallel side walls internal faces of the side walls comprise opposite pairs of bar positioning elements for connecting one end of the bracelet to one of said pairs of positioning elements.

6. The clasp as claimed in claim 5, wherein second stop serves to limit the amplitude of pivoting of said first cover relative to said second link.

7. The clasp as claimed in claim 6, wherein a portion of said lever situated, in a coupled position, on a side directed toward the articulation shaft of said branches relative to the lever shaft, extends under said first cover, which serves as the first stop to limit the pivoting of said lever about its articulation shaft under the torque, in a position corresponding to the engagement of said latching hook with said coupling element, the torque transmitted by the lever to the first cover via said link tending to press the first cover in a direction of the bracelet.

8. The clasp as claimed in claim 5, wherein a second cover is operatively, pivotally mounted about a cover shaft, the cover shaft being parallel to the articulation shaft, the second cover comprising a coupling element shaped to allow said latching hook to engage therewith, so that in a position pressed down toward the first cover, the second cover covers said lever and tends to oppose an opening of the lever.

9. The clasp as claimed in claim 8, wherein the lever shaft has two elastically retractable ends which protrude laterally and serve to engage, respectively, with two recesses made on two opposite side faces of said second cover to hold the second cover in position pressed down toward the first cover on said lever.

10. The clasp as claimed in claim 1 wherein an angle with which a first trajectory described by a coupling surface of said latching hook about the lever shaft intersects a second trajectory of said first and second branches about the articulation shaft is at least equal to 60° and the coupling surface of said latching hook is shaped so that, in a coupled position, a reaction to a force tending to separate said articulated first and second branches passes through an articulation shaft of said latching hook.

11. The clasp as claimed in claim 2, wherein said lever is connected at the free end of the first branch by a second link comprising at least two lever articulation shafts parallel to the articulation shaft of said first and second branches, a first lever articulation shaft for articulating the second link with respect to the free end of said first branch and a second lever articulation shaft for articulating the second link with respect to said lever.

12. The clasp as claimed in claim 6, including a second cover, operatively, pivotally mounted about a shaft parallel to the articulation shaft of said first and second branches at the free end of said first branch comprising a coupling element shaped to allow said latching hook to engage therewith, wherein, when the second cover is pressed down toward the first cover, the second cover covers said lever and tends to oppose the opening of the second cover.

13. The clasp as claimed in claim 7 including a second cover, operatively, pivotally mounted about a shaft parallel to the articulation shaft of said first and second branches at the free end of said first branch comprising a coupling element shaped to allow said latching hook to engage therewith, wherein, when the second cover is pressed down toward the first cover, the second cover covers said lever and tends to oppose the opening of the second cover.

14. The clasp as claimed in claim 2, wherein an angle with which a trajectory, described by a coupling surface of said latching hook about the lever articulation shaft, intersects a trajectory of said first and second branches about the articulation shaft of the first and second branches is greater than or equal to 60° and the coupling surface of said latching hook is shaped so that, in the coupled position, a reaction to a force tending to separate said first and second branches passes through an articulation shaft of said latching hook.

15. The clasp as claimed in claim 3, wherein an angle with which a trajectory described by a coupling surface of said latching hook about the lever articulation shaft intersects a trajectory of said first and second branches about the articulation shaft of the first and second branches is greater than or equal to 60° and the coupling surface of said latching hook is shaped so that, in a coupled position, a reaction to a force tending to separate said first and second branches passes through an articulation shaft of said latching hook.

16. The clasp as claimed in claim 4, wherein an angle with which a trajectory described by a coupling surface of said latching hook about the lever articulation shaft intersects a trajectory of said first and second branches about their articulation shaft of the first and second branches is greater than or equal to 60° and the coupling surface of said latching hook is shaped so that, in a coupled position, a reaction to a force tending to separate said first and second branches passes through an articulation shaft of said latching hook.

17. The clasp as claimed in claim 5, wherein an angle with which a trajectory described by a coupling surface of said latching hook about the lever articulation shaft intersects a trajectory of said first and second branches about the articulation shaft of the first and second branches is greater than or equal to 60° and the coupling surface of said latching hook is shaped so that, in a coupled position, a reaction to a force tending to separate said first and second branches passes through an articulation shaft of said latching hook.

18. The clasp as claimed in claim 6, wherein an angle with which a trajectory described by a coupling surface of said latching hook about the lever articulation shaft intersects a trajectory of said first and second branches about the articulation shaft of the first and second branches is greater than or equal to 60° and the coupling surface of said latching hook is shaped so that, in a coupled position, a reaction to a force tending to separate said first and second branches passes through an articulation shaft of said latching hook.

19. The clasp as claimed in claim 7, wherein an angle with which a trajectory described by a coupling surface of said latching hook about the lever articulation shaft intersects a trajectory of said first and second branches about the articulation shaft of the first and second branches is greater than or equal to 60° and the coupling surface of said latching hook is shaped so that, in a coupled position, a reaction to a force tending to separate said first and second branches passes through an articulation shaft of said latching hook.

20. The clasp as claimed in claim 8, wherein an angle with which a trajectory described by a coupling surface of said latching hook about the lever articulation shaft intersects a trajectory of said first and second branches about the articulation shaft of the first and second branches is greater than or equal to 60° and the coupling surface of said latching hook is shaped so that, in a coupled position, a reaction to a force tending to separate said first and second branches passes through an articulation shaft of said latching hook.

* * * * *